United States Patent [19]

Balevski et al.

[11] Patent Number: 4,671,342

[45] Date of Patent: Jun. 9, 1987

[54] METHOD OF AND APPARATUS FOR CASTING METALS UNDER PRESSURE

[75] Inventors: Angel T. Balevski; Ivan D. Nikolov; Emil N. Momchilov; Rumen D. Bachvarov; Vassil N. Ostrovski; Alexander S. Nikolchov; Peyo T. Stoyanov; Valentin G. Petrov; Toshko K. Lyubenov, all of Sofia, Bulgaria

[73] Assignee: Institute po Metaloznanie i Technologia NAMetalite, Sofia, Belgium

[21] Appl. No.: 801,239

[22] Filed: Nov. 25, 1985

[51] Int. Cl.[4] ..... B22D 18/04; B22D 46/00

[52] U.S. Cl. ..... 164/458; 164/150; 164/154; 164/306; 164/119

[58] Field of Search ..... 164/458, 457, 154, 150, 164/119, 306, 55.1

[56] References Cited

U.S. PATENT DOCUMENTS

| | | | |
|---|---|---|---|
| 1,491,173 | 4/1924 | Schwartz | 164/458 |
| 3,196,501 | 7/1965 | Balevsky et al. | 164/119 |
| 3,761,218 | 9/1973 | Portalier | 164/306 |
| 3,893,502 | 7/1975 | Slamar | 164/150 |
| 3,899,021 | 8/1975 | Alexandrov et al. | 164/306 |
| 3,931,847 | 1/1976 | Terkelsen | 164/458 |
| 4,014,683 | 3/1977 | Miltenberger | 164/55.1 |
| 4,252,174 | 2/1981 | Miki et al. | 164/151 |

FOREIGN PATENT DOCUMENTS

| | | | |
|---|---|---|---|
| 908489 | 2/1982 | U.S.S.R. | 164/458 |

OTHER PUBLICATIONS

Meals Handbook, 8th edition, vol. 5 "Die Design" pp. 294–300 and Control of Mold Temperature, pp. 275–277, 1970.

*Primary Examiner*—Nicholas P. Godici
*Assistant Examiner*—Samuel M. Heinrich

[57] ABSTRACT

Method of and apparatus for casting under pressure light metal alloys in which, under the action of a pressure difference, the molten metal from a furnace, disposed in a hermetically sealed chamber, is displaced via a feed tube for molten metal and fills the cavity of a casting mold, disposed in another hermetically sealed chamber, wherein before the filling of the cavity of the casting mold with molten metal, the latter is subjected to a temperature and a metallurgical pretreatment in two furnaces, which are then in succession brought in position of casting and, at the same time or later, the casting mold is brought to desired temperature parameters, the process of casting is performed, the cast body is removed from the casting mold and the cycle is repeated. The temperature of the casting mold, before and after its filling with molten metal, is regulated by controlling the powers of the cooling and the heating systems arranged within the casting mold. During the solidification of the cast body until its removal, there is regulated the deformation state of the system cast body mold by controlling the clearance and the force of seizing between the cast body and the walls of the casting mold. Both furnaces are arranged in front of the casting machine on receiving devices, carried by a horizontally movable shuttle in left or right position, and in these positions there are provided devices for metallurgical pretreatment and systems for temperature pretreatment of the molten metal in the furnaces.

7 Claims, 3 Drawing Figures

METHOD OF AND APPARATUS FOR CASTING METALS UNDER PRESSURE

This invention relates to a method of and an apparatus for casting metals under a pressure produced by a gaseous phase, the invention can find application in foundry engineering for the production of castings with high physical and mechanical characteristics of light metal alloys.

A method for casting metals under pressure is known (U.S. Pat. No. 3,196,501) in which, under the action of a pressure difference, the molten metal from a furnace, disposed inside a hermetically sealed supply chamber, is displaced via a conduit for molten metal and fills the cavity of a casting mold, disposed in another hermetically sealed equalizing chamber, where the cast body solidifies at the existing temperature and pressure and then the ready cast body is removed from the casting mold and new cycle of casting is started.

The aforedescribed prior method does not consider or take note of any metallurgical and temperature pretreatment of the molten metal in the furnace immediately before the filling of the casting mold, and does not relate these pretreatments with the preparation of the mold for the casting. The process also does not consider the method of controlling the temperature of the casting mold during the filling of its cavity with molten metal or during the solidification of the cast body. These elements of the entire process of casting under pressure are of particular importance for the production of cast bodies with umambiguously determined and high physical and mechanical characteristics.

A known machine for casting under pressure (U.S. Pat. No. 3,899,021), which performs the aforedescribed prior method, consists of two hermetically sealable chambers: a supply chamber and an equalizing chamber for a furnace with molten metal and for a casting mold, respectively, which are interconnected by means of a conduit for molten metal and are separated one from another by an intermediate platen, on which there is mounted a conduit for molten metal. The casting mold is disposed on the intermediate platen, to which there is also fastened a two-part hood which forms the equalizing chamber. The intermediate platen is vertically movable together with the casting mold. The furnace of the machine is mounted in the machine in such manner, that it is possible, when the intermediate platen is lifted, to take it out and charge it outside of the machine. The pneumatic system of the machine, which is not shown in U.S. Pat. No. 3,899,021, is of a known type, as shown in U.S. Pat. No. 3,196,501, and consists of a reservoir for process gas, connected via respective pipe conduits and valves to both hermetically sealable chambers, which have outlets with respective valves and to the atmosphere. The regulation of the temperature parameters of the casting process, such as those of the molten metal in the furnace, of the casting mold and others is effected by switching on or off the heating or cooling system of a generally known type.

A basic drawback of the known machine for casting under pressure lies in that, when the molten metal in the furnace is exhausted and if a more prolonged metallurgical and temperature treatment of the molten metal in the furnace is necessary, the casting process must be interrupted for a long time and this will affect the output of the machine, as well as the quality of the cast bodies and all this with increased energy losses.

Another drawback lies in that, because of the great number of branchings of the gas conduits of the pneumatic system and the change of direction of motion of the gas flows during filling and release, sometimes there is produced a shaking of the level of the molten metal and a stirring up with gaseous phase, which result in a worsening of the parameters of the cast bodies.

A drawback of the machine also lies in the fact that the regulation of the temperature is effected only by switching on and off of the heating and the cooling systems, which does not provide for a sufficient accuracy.

Another drawback lies also in that, in case of necessity of replacement of the conduit for molten metal, it is necessary to disassemble and remove outside the machine the upper part of the hood and the casting mold, to interrupt the connections between the bottom part of the hood and the bottom part of the casting mold and, moreover, additional equipment is required.

It is therefore a general object of the invention to provide a method of and an apparatus for casting under pressure, by which there can be produced cast bodies of high and constant physical and mechanical characteristics with an increased degree of automation, output and convenience in attendance. This object is achieved, according to the invention, by the provision of a method for casting under pressure in which, under the action of a pressure difference, molten metal from a furnace, disposed inside a hermetically sealed supply chamber, is displaced via a conduit for molten metal and fills the cavity of a casting mold disposed inside another hermetically sealed equalizing chamber, where the cast body solidifies. Then the cast body is removed from the casting mold and preparations for a new cycle of casting are started.

Before filling the casting mold with molten metal, the latter is subjected to a temperature and metallurgical pretreatment in two furnaces, disposed into the position immediately close to the casting machine, and then the furnaces are brought in succession in position of casting and, simultaneously or after that, the casting mold is brought to the desired temperature parameters. Before, as well as after the filling, the temperature of the casting mold is regulated by varying the powers of the heating and the cooling systems arranged in the casting mold and then, until the removal of the cast body from the casting mold, the deformation state of the system cast body-mold is regulated by taking into consideration the clearance and the force of seizing between the cast body and the casting mold. The regulation of the temperature is effected by conversion by time of the temperature control signal, and there are differentiated two control signals, the ratio between which corresponds to the ratio between the powers of the cooling and heating systems. The regulation of the deformation state is effected so that the cooling is stopped when a clearance appears between the cast body and the mold, and when the force of seizing between the cast body and mold exceeds a preset value the cooling is switched on.

The object is also achieved by an apparatus for casting under pressure, which comprises a casting machine with two movable furnaces, a mixing device for charging the furnaces with molten metal, a pneumatic system for the displacement of the molten metal from the furnace to the cavity of a casting mold via a conduit for molten metal, and a control block, comprising a comparison block, the inputs of which are respectively connected to a set-up block and a temperature transducer, while its output is connected to the first inputs of two actuating blocks, to the second inputs of which there are connected respectively two set-up blocks, while their outputs are connected respectively to the cooling and the heating system, as well as to the input of a regulating amplifier, the output of which is connected to the one contact of a switch, to the second contact of which there is connected a multivibrator.

The control block also comprises control blocks for the movements, the pneumatic processes and the metallurgical pretreatments, as well as a set-up block for the temperature of the molten metal. The casting machine comprises an equalizing chamber, formed of a two-part hood, and a supply chamber, which separated by an intermediate platen, in which there is mounted the conduit for molten metal and inlet holes for the pneumatic system. The casting mold is mounted on the intermediate platen in the area of the equalizing chamber. In front of the casting machine there are formed a left and a right positions with equipment for metallurgical pretreatment of the molten metal in the furnaces, these furnaces being connected by means of flexible communication connections with systems for temperature pretreatment of the molten metal and there are arranged receiving devices, a left and a right one, carried by a horizontally moved shuttles, underneath which there is disposed a communication unit, supplying the equipment for metallurgical pretreatment of the molten metal.

To the casting machine there are mounted: a control block connected in series with transducers for temperature and deformations, a cooling system and a heating system arranged in the casting mold, the systems for temperature pretreatment of the molten metal in the furnaces and the equipment for metallurgical pretreatment of the molten metal in the furnaces. The pneumatic system comprises two two-position four-way distributors, connected via pipe conduits to the inlet holes of the intermediate platen, as well as respectively to the reservoir for process gas and the atmosphere or an installation for exhaust gas, and at the same time also to the inlet and outlet of a stopping valve. To the bottom part of the hood, which forms the equalizing chamber, there is mounted rigidly a support, entering in a neck of the bottom part of the casting mold. The control block comprises a time converter, the first input of which is connected to the output of a switch, while its second input is connected to a set-up block and its outputs are connected respectively to the third input of a second actuating block. The control block also comprises a second comparison block, the first input of which is connected to a set-up block for deformation parameters, to its second input there is connected the transducer for deformations, while its output is connected to the input of a regulator, to the output of which there is connected the fourth input of the actuating block.

The advantages of the method and the apparatus, according to the invention, lie in the following:

they allow the realization of high physical and mechanical characteristics of successively cast bodies by accurately regulating the parameters of the technological process;

they allow an increase of the output by matching the ancillary operations, eliminating the causes for reject and increasing the degree of automation of the processes;

the attendance of the apparatuses is improved, particularly when it is necessary to replace the feed tube for molten metal.

For a better understanding of the invention, reference should be made to the accompanying drawings in which there is illustrated and explained a preferred embodiment of an apparatus by which the method of the invention is to be performed.

Figure 1:
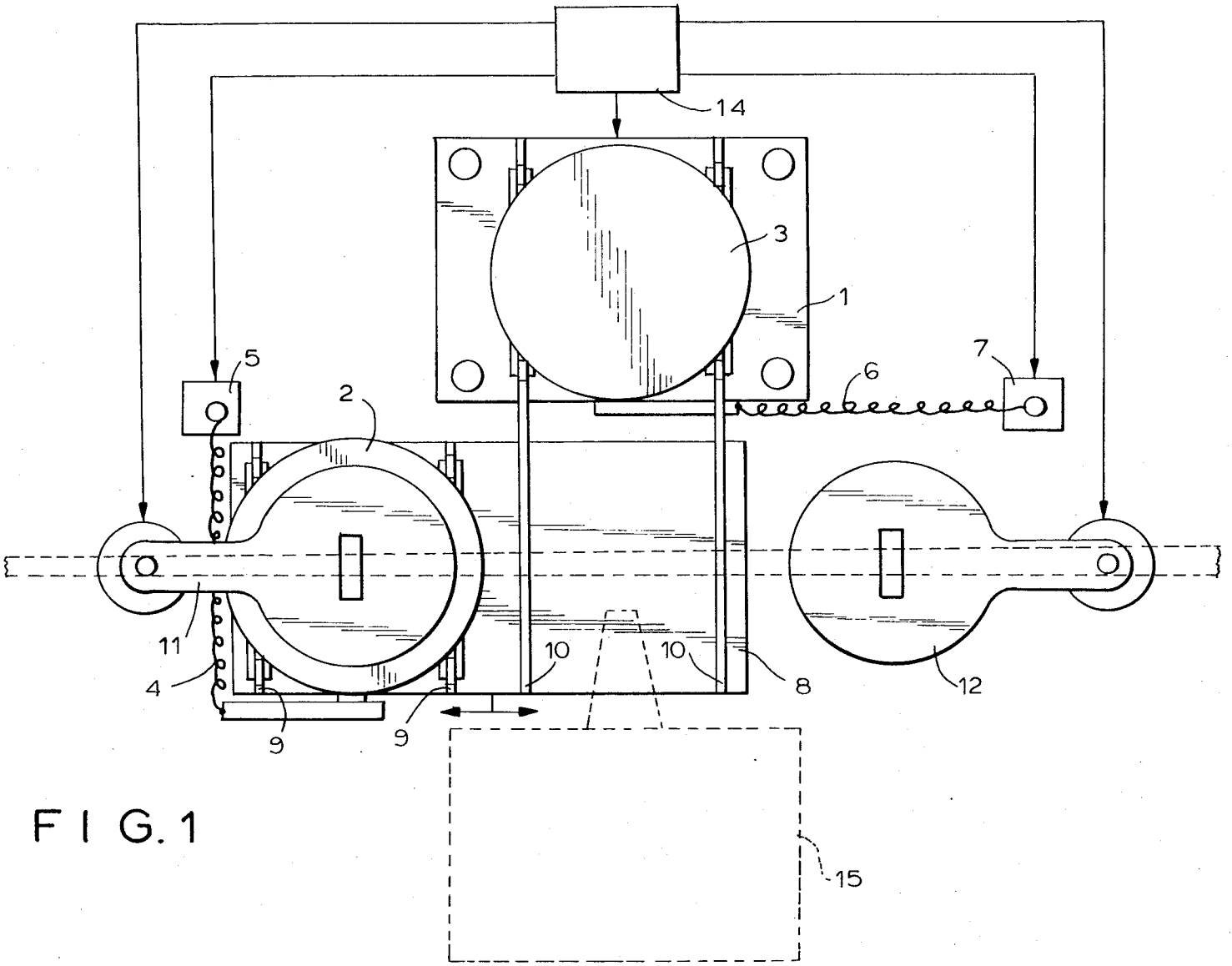
FIG. 1 is a plan view of the apparatus for casting under pressure.

Turning first to FIG. 1, the apparatus consists of a casting machine 1, comprising two movable furnaces, a left furnace 2 and a right furnace 3. The left movable furnace 2 is connected by means of a flexible communication connection 4 to a left molten metal temperature pretreatment system 5, while the right movable furnace 3 is connected by means of a second flexible communication connection 6 to a right molten metal temperature pretreatment system 7. In front of the for casting machine 1 there is mounted a movable shuttle 8, onto which there are disposed two receiving devices, a left device 9 and a right device 10.

Each of the movable furnaces 2 and 3, in respective end positions of the movable shuttle 8 is provided with a respective device for metallurgical pretreatment of the molten metal 11 and 12. Each device for metallurgical pretreatment of the molten metal 11 and 12 consists of a cantilever and an actuating member. The base of each cantilever is attached laterally to the movable shuttle 8, while the actuating member is disposed coaxially above the respective movable furnace, the left furnace 2 or the right furnace 3. Underneath the movable shuttle 8 there is formed a communication unit 13, which supplies the devices 11 and 12 for metallurgical pretreatment of the molten metal. To the casting machine 1 there is provided a command block 14, connected to both systems 5 and 7 for temperature pretreatment of the molten metal, as well as to both devices 11 and 12 for metallurgical pretreatment of the molten metal. In front of the movable shuttle 8 and opposite to the casting machine 1 there is mounted a mixer 15.

Figure 2:
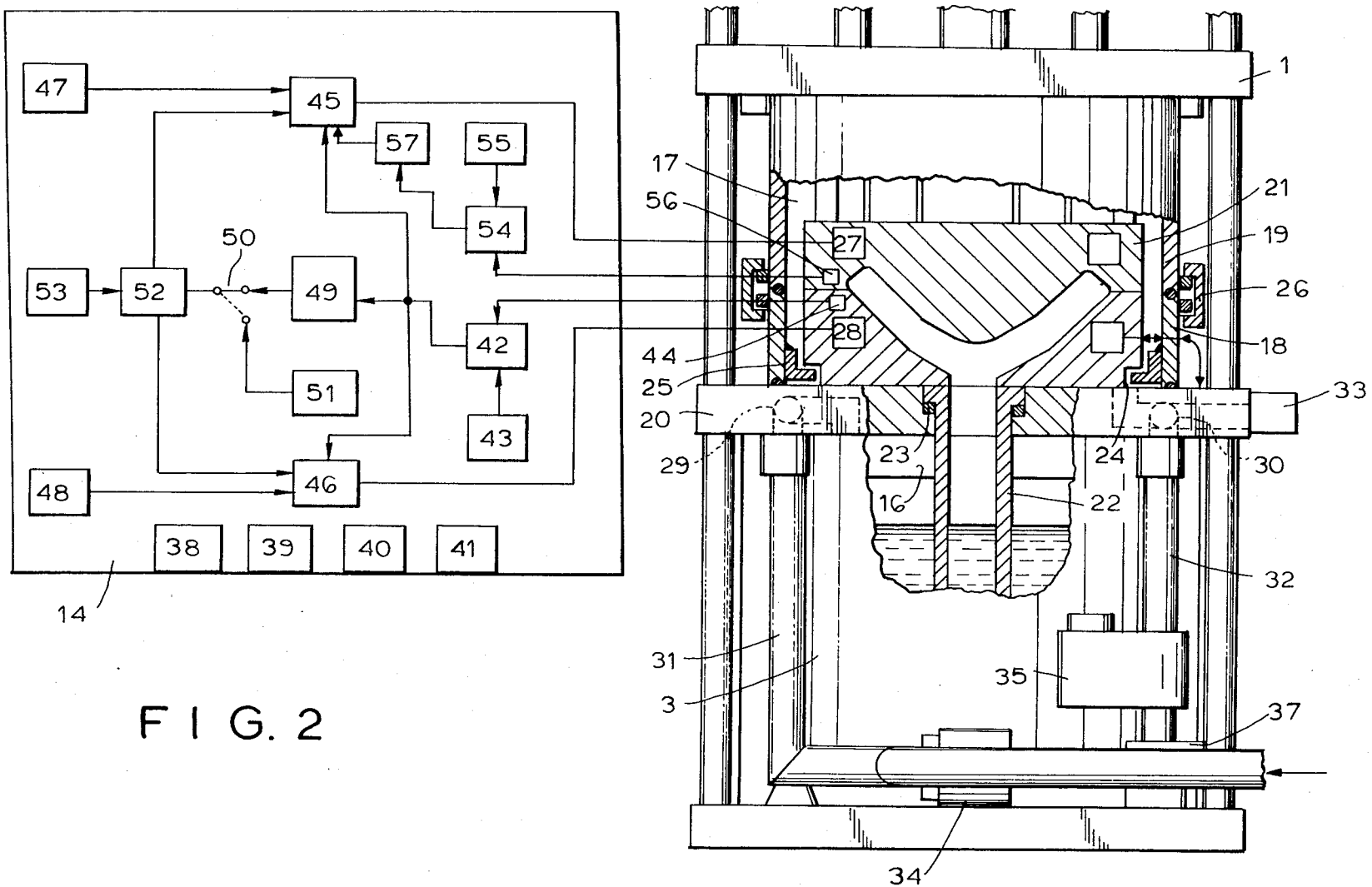
FIG. 2 is a general view partially in vertical section and partially in side elevation of the casting machine, with diagrammatic representation of the control block.

As shown in FIG. 2, casting machine 1 comprises a supply chamber 16, formed by the left 2 or the right 3 movable furnace and of the equalizing chamber 17 formed by a bottom hood 18 and a top hood 19, which are connected by means of a detachable joint 26. Said chambers 16 and 17 are isolated in-between by the intermediate platen 20, onto which the casting mold 21 is mounted in the area of the equalizing chamber 17. The casting mold 21 is connected to the supply chamber 16 via one or several feed tubes 22 for molten metal, which pass through the intermediate platen 20 and are immersed in the molten metal. the feed tube 22 for molten metal is pressed against the intermediate platen 20 by the bottom part of the casting mold 21 and the sealing gasket 23. in the bottom part of the casting mold 21 there is machined a neck 24 in which there is set-up with clearance a support 25, which is fastened to the bottom hood 18. Moreover, in the casting mold 21 there are provided a cooling system 27 and a heating system 28, which are connected to the command block 14.

In the intermediate platen 20 there are formed a first hole 29 and a second hole 30, the first hole 29 being connected at its one side to the outlet of a first gas conduit 31, and at its other side it is connected to the supply chamber 16, while the second hole 30 is connected in its one side to the outlet of a second gas conduit 32, and in its other side, to the equalizing chamber 17, and on a third side, to a valve 33 for producing a difference in the pressures between both chambers, the gas conduits 31 and 32 eing telescopic and disposed coaxially underneath the respective first and second holes 29 and 30. In the inlet of the first gas conduit there is mounted a first two-position four-way distributor 34 for filling, which is provided with outlets A, B, C, D, while in the inlet of the second gas conduit 32 there is mounted a second, identical with the first one, two-position four-way distributor 35 for exhaust, which is provided with outlets E, F, G, H. The outlets A and B of the distributor 34 for filling are connected to a reservoir 36 for process gas, the outlet C is connected to the inlet of the first gas conduit 31, the outlet D is connected to the inlet of the stopping valve 37, to the outlet of which there is connected the outlet E of the distributor 35 for exhaust, the outlet F is connected to the inlet of the second gas conduit 32, while the outlet G and H are connected to the atmosphere.

When the distributor 34 for filling and the distributor 35 for exhaust are in positions connecting, respectively, the outlets C to D and E to F, the inlet of the stopping valve 37 is connected to the inlet of the first gas conduit 31 via a first coaxial pneumatic line C-D, the outlet of the stopping valve 37 is connected to the inlet of the second gas conduit 32 via a second coaxial pneumatic line E-F, said first gas conduit 31 up to its connection to the first hole 29 in the intermediate platen 20 forms only on L-shaped knee, while the second gas conduit 32 is coaxial to the second coaxial pneumatic line E-F. When the distributor 34 for filling is in a position connecting the outlets A to D and B to C and the stopping valve 37 is in a position connecting the inlet to the outlet, then the reservoir for process gas 36 is at the same time and independently connected via the first gas conduit 31 to the supply chamber 16, and via the second gas conduit 32 and the second coaxial pneumatic line E-F, to the equalizing chamber 17. When the distributor 35 for exhaust is in a position connecting the outlets E to G and F to H, and the stopping valve 37 is in a position connecting the inlet to the outlet, then the supply chamber 16, via the first gas conduit 31 and the first coaxial pneumatic line C-D, and the equalizing chamber 17, via the second gas conduit 32, are at the same time independently connected to the atmosphere.

The command block 14 switches-on the block for control of movement 38, the block for control of the pneumatic processes 39, the block for control of the pneumatic processes 39, the block for control of the metallurgical pretreatment 40, and the set-up block 41 for the temperature of the molten metal, connected to the respective devices and systems. The command block 14 switches-on also a comparison block 42, the inputs of which are connected to a set-up block 43 for the desired temperature and the temperature transducer 44 mounted in the casting mold 21. The output of the comparison block 42 is connected to the first inputs of two actuating blocks 45 and 46, to the second inputs of which there are connected respectively the outputs of two set-up blocks 47 and 48, while their outputs are connected, respectively, to the cooling system 27 and the heating system 28; as well as to the input of a regulating amplifier 49, the output of which is connected to one contact of the switch 50, the second contact of which is connected to a multivibrator 51. The output of the switch 50 is connected to the one input of a time converter 52, to the second input of which there is connected the output of a set-up block for ratio 53. The one output of the time converter 52 is connected to the third input of the first actuating block 45, and its other output, to the third input of the second actuating block 46. Similarly, the command block 14 switches another comparison block 54, the inputs of which are connected to a set-up block 55 for deformation parameters and to the transducer 56 for deformation parameters mounted in the casting mold 21, while its output is connected to the input of the amplifier 57, the output of which is connected to the fourth input of the first actuating block 45.

The apparatus by which the method of the invention is performed operates as follows:

The left furnace 2 is charged with molten metal from the mixer 15. The shuttle 8 is moved to an end left position. The left system 5 for temperature pretreatment is actuated. After the termination of the temperature pretreatment, the left device 11 for metallurgical pretreatment is switched-on. After the termination of the metallurgical treatment, the right furnace 3 is moved on the right receiving device 10, which is disposed frontally oppsoite to the axis of the casting machine 1. The right furnace 3 is charged with molten metal from the mixer 15, and then the shuttle 8 is moved to an end right position. The left receiving device 9 is thus positioned in the same place, where the right receiving device 10 has been before the displacement. At the same time, the right furnace 3 is disposed in the area of the right device for metallurgical pretreatment 12. The right system for temperature pretreatment of the molten metal 7 is switched on and, at the same time, the left furnace 2 is introduced into the casting machine 1, and then the process of casting is started. In the meantime the temperature of the die has reached the desired initial value, which is regulated as follows:

When the temperature measured by the transducer 44 differs from the preset one, by means of the set-up block 43 there is produced a difference, entering the firt inputs of the actuating blocks 45 and 46 and the input of the regulating amplifier 49.

On the basis of this difference and one the previously programed law (proportional, integral, differential, normal, and others), the regulating amplifier 49 forms an analogue or pulse control signal. At the upper position of the switch 50, this control signal enters the one input of the time converter 52 and if it has an analogue character the conversion is effected on the basis of pulse chopping. In the first and second output there are differentiated respectively two pulse control signals with a ratio between them corresponding to each signal-proportional pause-pulse, in turn corresponding to the law entered in the second input by means of the set up block for ratio 53. If the control signal is of the pulse type, the conversion is effected on the basis of the increase or reduction of the duration of the pulses and pauses, while the differentiated respective control signals in both ouptuts preserve the aforedescribed ratio, but at another duration of the period, corresponding to the period of the control signal entering the first input. If the law preset by means of the set up block for ratio 53 is changed, there is also changed the ratio between the proportions pause-pulse for each differentiated control signal and as a result, on one part, there is increased the duration of the pulse for the one and the duration of the pause for the other and, on the other part, there is reduced the duration of the pause for the first and duration of the pulse for the second differentiated control signals at variations in one direction, i.e. at increase (or reduction, respectively) of the difference in the powers of the cooling system 27 and the heating system 28, or vice versa at variations in the other direction.

When the difference entering the first input of the first actuating block 45 is positive and exceeds the positive boundary value of the difference preset at the second input by means of the set up block 47, at the output there is obtained the differentiated control signal entering the third input, which enters the cooling system 27 and controls its operation. At the same time, this positive difference, entering the first input of the second actuating block 45, cannot drop below the preset by means of the other set up block 48 negative boundary value of the difference, and the heating system 28 does not operate because it does not receive the second differentiated control signal. Similarly, when the difference is negative, the heating system 28 will operate, while the cooling system 27 will not receive a control signal. In bottom position of the switch 50, there enters from the multivibrator 51 to the first input of the time converter 52 a pulse control signal with rigid law, which undergoes a conversion similar to the aforedescribed.

As a result of the thus described regulation, there is effected the maintenance of the temperature within narrow limits around the preset temperature because of the bounding of the method of regulation with the specific design and technological features of the casting mold 21, equipped with a cooling system 27 and a heating system 28 of different power.

Figure 3:
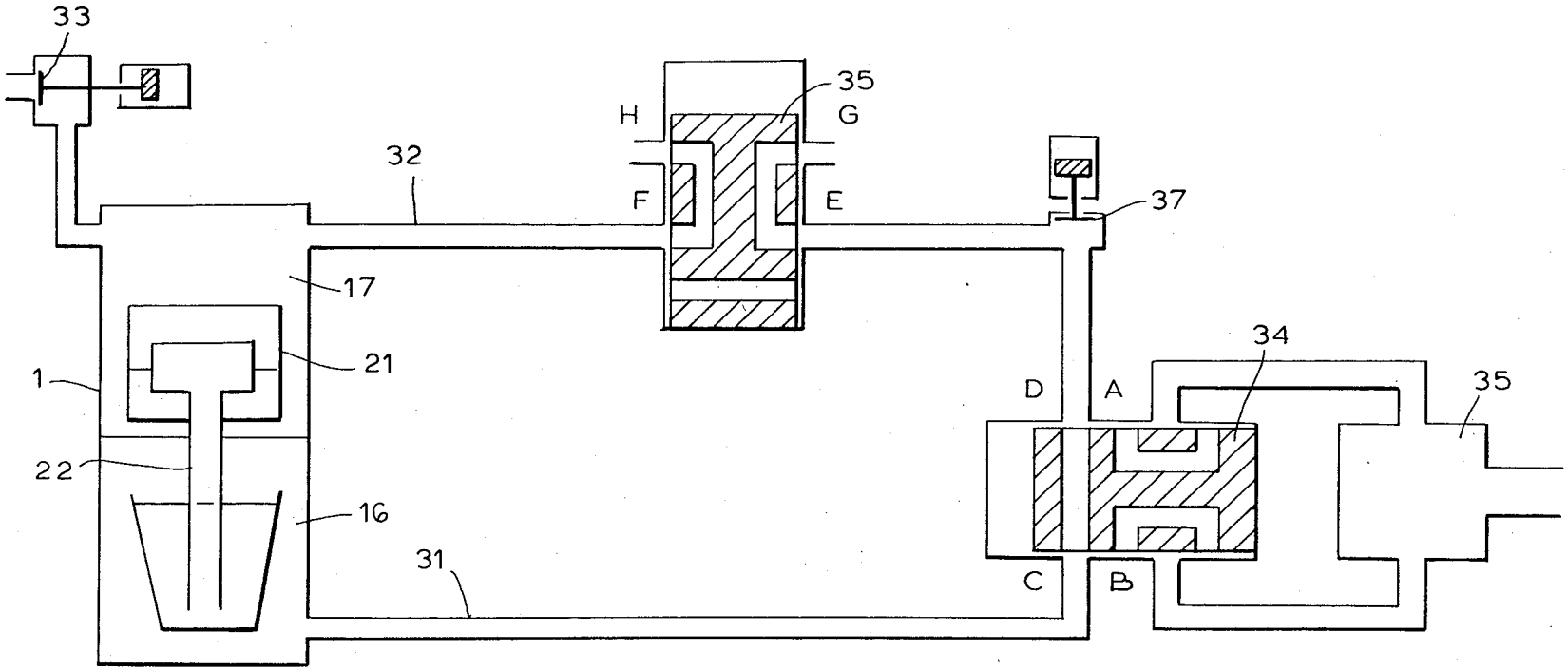
FIG. 3 is a diagrammatic representation of the pneumatic control system.

The filling of the casting mold 21 with molten metal is effected as follows:

The initial position of the valves and distributors is according to the diagram in FIG. 3:

the valve 33 for producing a difference is closed;

the distributor 34 for filling is in a position connecting the outlets C and D;

the distributor 35 for exhaust is in a position connecting the outlets E to G and F to H;

the stopping valve 37 is in a position connecting the inlet with the outlet (open).

The outlet of the stopping valve 37 is connected to the inlet of the second gas conduit via the second coaxial pneumatic line E-F, and the distributor 35 for exhaust is brought in position connecting E and F. The reservoir 36 for process gas is connected independently to the supply chamber 16 via the first gas conduit 31 and, at the same time, also to the equalizing chamber 17 via the second gas conduit 32 and the second coaxial pneumatic line E-F by bringing the distributor 34 for filling in a position connecting the outlets A to D and B to C. The supply chamber 16 and the equalizing chamber 17 are filled simultaneously and individually with process gas. After establishing the preset working pressure in the chambers 16 and 17, the distributor 34 for filling is returned in the position connecting the outlets C and D. The chambers 16 and 17 are separated by closing the stopping valve 37. Valve 33 is opened to produce a difference until there is reached the technologically preset differential between the pressures in both chambers 16 and 17, and then valve 33 is again closed. The molten metal flows smoothly through the feed tube 22 for molten metal and fills the cavity of the casting mold 21.

When the temperature of the mold is increased as a result of its filling with molten metal above a preset value, in the comparison block 42 there is produced a control difference, which enters the regulating amplifier 49, where there is formed by a respective law a control signal, and by means of the actuating block 45 the cooling system 27 is actuated. This causes temperature, as well as deformation variations in the system cast body mold. After the formation of the initial solid skin during the process of solidification (crystallization), the cast body increases its strength and, in a tendency to follow the law of variation of its sizes, effects or tends to effect a relative displacement with respect to the mold and, at that, there is varied the contact between its different portions, and the corresponding portions of the shape-forming contour of the mold.

When there appears a clearance between the cast body and enclosing its portions of the shape-forming contour of the mold, such clearance exceeds the values preset bymeans of the set up block 55, the second comparison block 54 sends to the regulator 57 a control difference which forms a control signal for the actuating block 45, which switches-off the cooling system 27. This continues until the preset contact between the cast body and the mold has been restored. In the other case, when the degree of interaction between the cast body and the enclosing it shape-forming components is increased, i.e. when the force of seizing exceeds a preset value and the temperature is such, that the cooling system 27 is not switched-on, the control difference of the second comparison block 54 causes in the regulator 57 the formation of a control signal, which by means of the actuating block 45 actuates the cooling system 27, and this causes a deformation of the enclosing shape-forming component.

When the technological time for solidification under a differential is terminated, the stopping valve 37 is opened (it is brought in initial position). After the termination of the technological time for solidification under pressure without differential, the equalizing chamber 17 is connected independently with the atmosphere via the second gas conduit 32, and simultaneously the supply chamber 16 is connected independently to the atmosphere via the first gas conduit 31 and the first coaxial pneumatic line C-D by bringing back the distributor 35 for exhaust in a position connecting the outlets E to G and F to H (initial position). The process gas is released simultaneously independently from both chambers 16 and 17. The casting machine 1 is opened, the cast body is removed and at the same time there is prepared also the initial temperature of the casting mold 21 for the next-following casting, the regulation being effected by the aforedescribed method. Meanwhile, in a suitable moment, there is switched-on the right device for metallurgical pretreatment of the molten metal 12, which effects the treatment of the molten metal in the right furnace 3.

After the exhaust of the molten metal from the left furnace 2, the latter is moved onto the left receiving device 9, it is charged with molten metal from the mixer 15, and then the shuttle 8 is moved left to its end position. Then a similar process is also carried out with the right furnace 3. If during the casting the feed tube 22 for molten metal gets out of use because of wear or other causes, there are released the joints between the intermediate platen 20 and respectively the bottom hood 18 and the bottom part of the casting mold 21. In the closed position of the casting machine 1 there is effected a connection between the bottom hood 18 and the top hood 19 by means of a detachable joint 26. The machine 1 is opened, thus lifitng the bottom hood 18. The aforementioned motion of the bottom hood 18 eliminates the clearance between the bottom part of the casting mold 21 and the support 25 in the neck 24, and there is effected a connection in the neck 24 between the bottom hood 18 and the bottom part of the casting mold 21 by means of the support 25. As a result of this condition, the casting mold 21 is lifted when the casting machine 1 is opened, a clear space on the upper face of the intermediate platen 20 is made free, and it is possible to replace the feed tube 22 for molten metal and, if necessary, also the sealing gasket 23. Then the initial connections are restored and the casting continues.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. In a method for casting metal under pressure, in which, under the action of a difference in pressures, the molten metal from a furnace, contained in a hermetically sealed chamber, is displaced via a feed tube for molten metal and fills the cavity of a casting mold disposed in another hermetically sealed chamber where the cast body solidifies and after its removal from the casting mold there is prepared a new cycle of casting, the improvement wherein, before the filling of the cavity of the casting mold with molten metal, the latter is subjected to a temperature and a metallurgical pretreatment in both of two movable furnaces, cyclically disposed in positions for casting and, at the same time or after, the casting mold is brought to desired temperature parameters and, before as well as after the filling, the temperature of the casting mold is regulated by timed control of the ratio of powers of the heating and of the cooling systems, arranged within the casting mold, and then, until the removal of the cast body from the casting mold, there is regulated the deformation state of the system cast body mold by control of the clearance and the force of seizing between the cast body and the casting mold.

2. A method for casting under pressure according to claim 1, wherein regulation of the temperature is achieved by conversion of a temperature signal corresponding to the ratio between the powers of the cooling and heating systems into two time control signals each control signal comprising a timed pulse and a timed pause between two such pulses, wherein the ratio between the two time control signals also corresponds to the ratio between the powers of the cooling and heating systems, and selective activation and deactivation of the cooling and heating systems by comparison of the time control signals with a predetermined standard.

3. A method for casting under pressure according to claim 1, wherein the regulation of the deformation state is effected so that when there appears a clearance between the cast body and the mold the cooling is interrupted, and when the force of seizing between the cast body and the mold exceeds a preset value the cooling is switched-on.

4. An apparatus for casting metal under pressure, comprising a casting machine with two movable furnaces, a mixing device for charging the furnaces with molten metal, a pneumatic system for displacement of the molten metal from the furnace to the cavity of a casting mold via a feed pipe for molten metal, and a control block comprising a comparison block, the inputs of which are connected respectively to a set up block and a temperature transducer, while its output is connected to the first inputs of two actuating blocks, the second input of each such actuating block being connected to a set up block, while the outputs of the actuating blocks are connected, respectively, to the cooling and the heating systems, and the output of the comparison block is also connected to one contact of a switch, to the second contact of which there is connected a multivibrator, and the control block comprises also blocks for the control of the movements, the pneumatic processes and the metallurgical pretreatment, as well as a set up block for the temperature of the molten metal, and the casting machine comprises an equalizing chamber formed by a two-part hood and a supply chamber, separated by an intermediate platen, in which there are disposed the feed pipe for molten metal and inlet holes for the pneumatic system and onto the intermediate platen there is mounted the casting mold in the area of the equalizing chamber, wherein in front of the casting machine there are formed a left and a right positions with devices for metallurgical pretreatment of the molten metal in the furnaces, these furnaces being connected by means of flexible communication connections to systems for temperature pretreatment of the molten metal and they are disposed on receiving devices, a left one and a right one, which are carried by a horizontally movable shuttle, underneath which there is disposed a communication unit which supplies the devices for metallurgical pretreatment of the molten metal, and to the casting machine there are mounted: a control block connected in series with temperature transducer and deformation transducer, a cooling system and a heating system, arranged within the casting mold, systems for temperature pretreatment of the molten metal in the furnaces and devices for metallurgical pretreatment of the molten metal in the furnaces; a pneumatic system which comprises two two-position four-way distributors, connected via pipe conduits to the inlet holes of the intermediate platen as well as to a reservoir for process gas and the atmosphere or an installation for exhaust gas and at the same time, also to the inlet and the outlet of the stopping valve.

5. An apparatus for casting under pressure according to claim 4, wherein to the bottom part of the hood, forming the equalizing chamber, there is mounted rigidly a support which enters into a neck in the bottom part of the casting mold.

6. An apparatus for casting under pressure according to claim 4, wherein the control block comprising a time converter, the first input of which is connected to the output of the switch, the second input of which is connected to a set up block, while its outputs are connected respectively to the third input of the first actuating block and to the third input of the second actuating block.

7. An apparatus for casting under pressure according to claim 4, wherein the control block comprises also a second comparison block, the first input of which is connected to a set up block for deformation parameters, and to its second input there is connected a deformation transducer, while its output is connected to the input of an amplifier, to the output of which there is connected the fourth input of the actuating block.

* * * * *